US010500624B2

(12) United States Patent
Ageba et al.

(10) Patent No.: US 10,500,624 B2
(45) Date of Patent: Dec. 10, 2019

(54) PRESS FORMING METHOD AND TOOL OF PRESS FORMING

(71) Applicant: JFE STEEL CORPORATION, Tokyo (JP)

(72) Inventors: Ryo Ageba, Tokyo (JP); Akinobu Ishiwatari, Tokyo (JP); Jiro Hiramoto, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 231 days.

(21) Appl. No.: 15/552,615

(22) PCT Filed: Jan. 27, 2016

(86) PCT No.: PCT/JP2016/052300
§ 371 (c)(1),
(2) Date: Aug. 22, 2017

(87) PCT Pub. No.: WO2016/147703
PCT Pub. Date: Sep. 22, 2016

(65) Prior Publication Data

US 2018/0021831 A1 Jan. 25, 2018

(30) Foreign Application Priority Data

Mar. 18, 2015 (JP) ..... 2015-054952

(51) Int. Cl.
*B21D 22/21* (2006.01)
*B21D 19/08* (2006.01)
(Continued)

(52) U.S. Cl.
CPC ..... *B21D 19/08* (2013.01); *B21D 22/02* (2013.01); *B21D 22/20* (2013.01); *B21D 22/21* (2013.01); *B21D 22/30* (2013.01)

(58) Field of Classification Search
CPC ..... B21D 19/08; B21D 22/20; B21D 22/02; B21D 22/21; B21D 22/30; B21D 24/05
(Continued)

(56) References Cited

U.S. PATENT DOCUMENTS 2,321,344 A 6/1943 Whipple
9,211,579 B2 12/2015 Tanaka et al.
9,452,461 B2 9/2016 Yamagata et al.
(Continued)

FOREIGN PATENT DOCUMENTS

EP 1302657 A1 4/2003
JP S52-017363 A 2/1977
(Continued)

OTHER PUBLICATIONS

Apr. 26, 2016 International Search Report issued in Patent Application No. PCT/JP2016/052300.
(Continued)

*Primary Examiner* — David B Jones
(74) *Attorney, Agent, or Firm* — Oliff PLC

(57) ABSTRACT

A press forming method for forming a press-formed product having no flange portion from a blank by performing a crash forming process while using a die and a punch, the press-formed product including at least a top portion and a side wall portion continued from the top portion via a connecting portion and being structured so that either all or a part of the side wall portion curves toward an outside of the press-formed product to form a convex shape in a planar view, the press forming method including forming the side wall portion while keeping a tip end portion of the blank in continuous contact with a side wall forming portion of the die and causing the die to impose no restraint on any part other than the tip end portion of the blank.

1 Claim, 11 Drawing Sheets

(51) Int. Cl.
*B21D 22/02* (2006.01)
*B21D 22/20* (2006.01)
*B21D 22/30* (2006.01)

(58) Field of Classification Search
USPC ..... 72/379.2
See application file for complete search history.

(56) References Cited

U.S. PATENT DOCUMENTS

| | | | | |
|---|---|---|---|---|
| 10,286,436 | B2 * | 5/2019 | Sumikawa | B21D 22/26 |
| 2010/0018277 | A1 * | 1/2010 | Hielscher | B21D 24/16 72/352 |
| 2015/0290694 | A1 | 10/2015 | Urabe | |
| 2016/0121384 | A1 | 5/2016 | Sumikawa et al. | |

FOREIGN PATENT DOCUMENTS

| | | | |
|---|---|---|---|
| JP | H04-147718 | A | 5/1992 |
| JP | H06-047135 | B2 | 6/1994 |
| JP | 2005-095937 | A | 4/2005 |
| JP | 2005-254279 | A | 9/2005 |
| JP | 2008-200709 | A | 9/2008 |
| JP | 2010-075935 | A | 4/2010 |
| JP | 2014-004618 | A | 1/2014 |
| WO | 2012/070623 | A1 | 5/2012 |
| WO | 2014/109245 | A1 | 7/2014 |
| WO | 2014/132545 | A1 | 9/2014 |
| WO | 2014/208181 | A1 | 12/2014 |

OTHER PUBLICATIONS

Oct. 22, 2018 European Search Report issued in Patent Application No. 16764534.0.
Oct. 2, 2018 Korean Office Action issued in Patent Application No. 10-2017-7025627.
Aug. 6, 2018 Office Action isssued in Chinese Patent Application No. 201680015831.3.

* cited by examiner

PRESS FORMING METHOD AND TOOL OF PRESS FORMING

FIELD

The present invention relates to a press forming method and a tool of press forming used for a metal sheet, and particularly relates to a press forming method and a tool of press forming that are capable of preventing an occurrence of wrinkles during a crash forming process.

BACKGROUND

In recent years, high-strength steel sheets have been widely used in many automotive parts to realize weight reduction of automotive bodies to respond to environmental issues. To manufacture automotive parts, press forming processes are often used because press forming processes are excellent in view of manufacturing costs. However, since such high-strength steel sheets have a lower level of ductility than low-strength steel sheets, during a deep drawing process in which a blank holder force is applied while a tip end portion of a blank is gripped by a blank holder, a large strain tends to occur in the vicinity of the tip end portion of the blank, which, may easily lead to a fracture of the sheet.

Therefore, in such a case, a crash forming process is preferably used in many occasions, which is a kind of press forming process that primarily uses a bending deformation process without using the blank holder. However, during such crash forming processes, because the tension applied to a blank is small, excess metal caused by a shape of the manufactured component part may easily become a direct cause of wrinkles. It is therefore difficult to manufacture a press-formed product having a desired shape.

Patent Literature 1 describes a method for manufacturing an L-shaped product by performing a pressing process. According to this method, it is indicated that, by performing the pressing process while using a pad for preventing wrinkles, it is possible to avoid the occurrence of wrinkles in the top portion of the L-shape product and to avoid the occurrence of a fracture during a stretch flange forming process.

Patent Literature 2 discloses a method for manufacturing a component part that has an arc-shaped portion in a corner portion thereof, without generating wrinkles in a side wall portion thereof. This method includes: a step of manufacturing an intermediate formed product having no arc-shaped portion formed therein; and a step of completing the corner portion by performing a drawing process to form the arc-shaped portion in the intermediate formed product manufactured at the preceding step. It is indicated that it is possible to avoid the occurrence of wrinkles by making one or more incisions in such a section that does not reach the arc-shaped portion, the incisions each starting from the edge side of a flange portion.

Patent Literature 3 discloses a tool of press forming which applies a bending deformation process to make a hat-shaped cross section from a steel blank sheet and immediately after the bending deformation process is completed, to apply a compressive stress to a side wall portion of the steel blank sheet.

CITATION LIST

Patent Literature

Patent Literature 1: Patent International Publication No. WO2012/070623

Patent Literature 2: Japanese Laid-open Patent Publication No. 6-47135

Patent Literature 3: Japanese Laid-open Patent Publication No. 2005-254279

SUMMARY

Technical Problem

Examples of methods for preventing the occurrence of wrinkles during a press forming process include a method in which buckling of a blank caused by excess metal is prevented by applying a padding force in advance to a section where wrinkles may occur, by using a pad mechanism for preventing wrinkles that is powered separately from the pressing machine. However, although this method is applicable to a top portion of a part that can be held between a punch and a pad in an initial stage of the press forming process, this method is not applicable to a side wall portion of a part that has a large inclination angle with respect to the drive direction of the pressing machine.

In the method for manufacturing the L-shaped product by performing the pressing process described in Patent Literature 1, the occurrence of wrinkles in the vicinity of a curved portion of the top portion is prevented by arranging the blank to be held with pressure between the punch and the pad and maintaining the height of the pad at this level. However, although it is possible to prevent the occurrence of wrinkles only in the top portion of the product this method is not applicable to such component parts that are formed by a crash forming process where wrinkles may occur in a side wall.

The method described in Patent Literature 2 has a disadvantage in terms of productivity because the manufacturing process of the component part requires at least two steps. In addition, because it is necessary to make the incisions in the blank, a problem arises where there is a possibility that the component part may have a shape different from an originally-intended shape.

In the tool of press forming described in Patent Literature 3, the side wall portion is compressed by moving an upper bending blade of a die sideways with the use of a suspended slider that is slidably attached to an upper section of the tool, so as to pinch and hold the upper half of the side wall portion, while pressing the lower half thereof. However, in a press forming process of a component part having a side wall portion that curves outward in terms of the longitudinal direction, which is to be dealt with in the present application, it would be necessary to vary the shape of the upper bending blade of the tool of press forming in accordance with the curvature of the curving during the bending deformation process, because the curvature of the curving of the side wall portion changes during the bending deformation process. However, when the tool of press forming described in Patent Literature 3 is used, it is not possible to vary the shape of the upper bending blade during the bending deformation process. For this reason, using the tool of press forming described in Patent Literature 3 does not make it possible to manufacture a press-formed product that has a side wall portion curving toward the outside to have a convex shape in a planar view.

In view of the circumstances described above, it is an object of the present invention to provide a press forming method and a tool of press forming that, during a crash forming process to form a press-formed product that has a side wall portion curving toward the outside, in terms of the longitudinal direction, of the press-formed product to have a convex shape in a planar view, are able to form the side wall portion in a single step without the need to make incisions in the blank, while preventing the occurrence of wrinkles in the side wall portion.

Solution to Problem

To resolve the above problem and attain the object, a press forming method for forming a press-formed product having no flange portion from a blank by performing a crash forming process while using a die and a punch, the press-formed product including at least a top portion and a side wall portion continued from the top portion via a connecting portion and being structured so that either all or a part of the side wall portion curves toward an outside of the press-formed product to form a convex shape in a planar view, the press forming method including forming the side wall portion while keeping a tip end portion of the blank in continuous contact with a side wall forming portion of the die and causing the die to impose no restraint on any part other than the tip end portion of the blank.

Further, in the press forming method according to the present invention, the tip end portion of the blank of the above invention corresponds to an extent from a tip end of the blank defined by a distance up to four times longer than a thickness of the blank.

Further, a tool of press forming according to the present invention is used by the press forming method according to any of the above inventions and includes the punch and the die. Further, the side wall forming portion of the die has such a cross-sectional shape that, during a side wall forming process, the tip end portion of the blank is constantly kept in contact with the side wall forming portion.

Further, in the tool of press forming according to the present invention, according to the above invention, the cross-sectional shape of the side wall forming portion is such a shape that, during the side wall forming process, the extent from the tip end of the blank defined by the distance up to four times longer than the thickness of the blank is constantly kept in contact with the side wall forming portion.

Further, a tool of press forming according to the present invention is used for forming a press-formed product having no flange portion by performing a crash forming process and including at least a top portion and a side wall portion continued from the top portion via a connecting portion and being structured so that either all or a part of the side wall portion curves toward an outside of the press-formed product to form a convex shape in a planar view. The tool of press forming includes a punch that has a forming top portion on which a blank is placed, a punch shoulder portion that is continued from the forming top portion and extends along the curving of the press-formed product, and a forming wall portion continued from the punch shoulder portion; and a die that has a side wall forming portion that forms the side wall portion of the press-formed product by moving relative to the punch. Further, in an X-Y coordinate system in which an origin is a point serving as a center of a radius curvature of the curving on the forming top portion, while an X-axis corresponds to a horizontal direction, whereas a Y-axis corresponds to a vertical direction, a curve drawn by a formula presented below is referred to as an optimal curve, while an inclination angle of a tangential line of the optimal curve at an arbitrary X-coordinate position is referred to as an optical inclination angle, and the side wall forming portion of the die has a cross-sectional shape expressed with a curve where an inclination angle of a tangential line at the arbitrary X-coordinate position with respect to the horizontal direction is equal to or greater than the optimal inclination angle.

$$\left.\begin{aligned} X &= pr - R + (R+t)\sin\theta + \left\{br - (pr - R) - \left(R + \frac{t}{2}\right)\theta\right\}\cos\theta \\ Y &= -\int_0^{\theta}\left[\frac{T}{2}\sin\theta - \left\{br - (pr - R) - \left(R + \frac{t}{2}\right)\theta\right\}\sin\theta\tan\theta\right]d\theta \end{aligned}\right\}$$

where pr: a radius [mm] of the punch;

R: a radius curvature [mm] of the punch shoulder portion;

br: a radius [mm] of the blank;

t: a thickness [mm] of the blank; and

θ: a contact angle ($0 \le \theta \le \pi/2$) [rad] of the blank with respect to the punch shoulder portion.

Advantageous Effects of Invention

The press forming method and the tool of press forming according to the present invention achieves an advantageous effect where it is possible to easily form the side wall portion curving toward the outside of the press-formed product to have a convex shape in a planar view, in the single step without the need to make incisions in the blank, while preventing the occurrence of wrinkles.

DESCRIPTION OF EMBODIMENTS

Exemplary embodiments of a press forming method and a tool of press forming of the present invention will be explained in detail below, with reference to the accompanying drawings. The present invention is not limited by these embodiments.

First Embodiment

Figure 1:
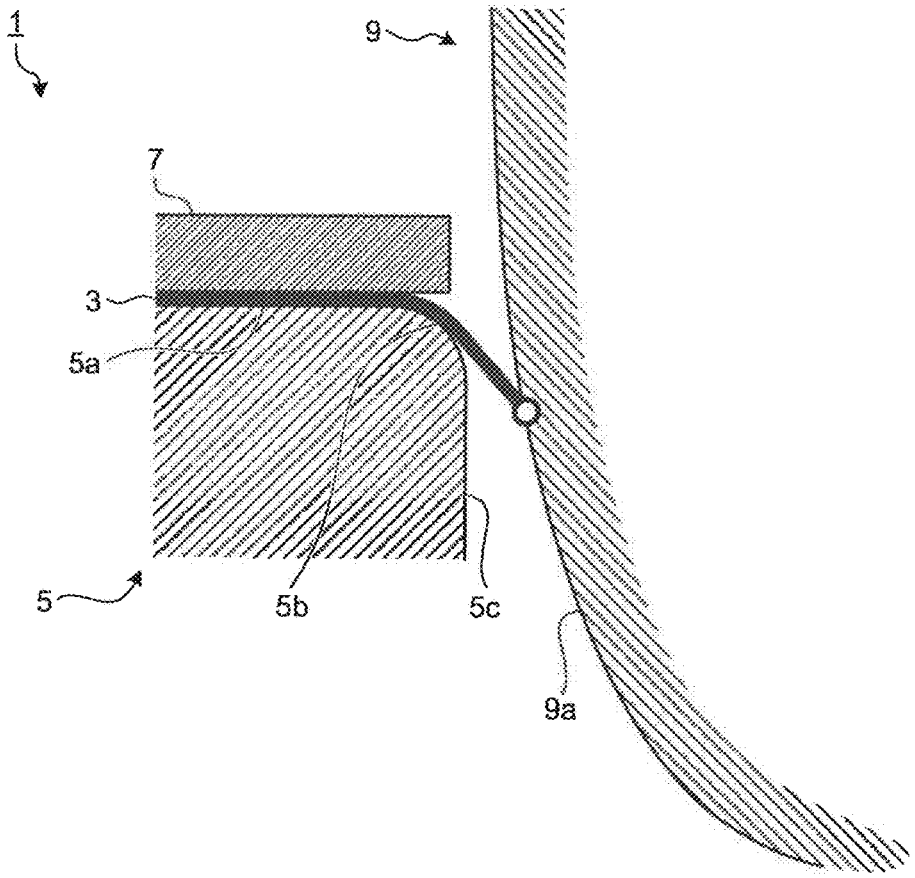
FIG. 1 is a cross-sectional view of a tool of press forming used for explaining a press forming method according to a first embodiment of the present invention and an exemplary configuration of a tool of press forming according to a second embodiment.
Figure 2:
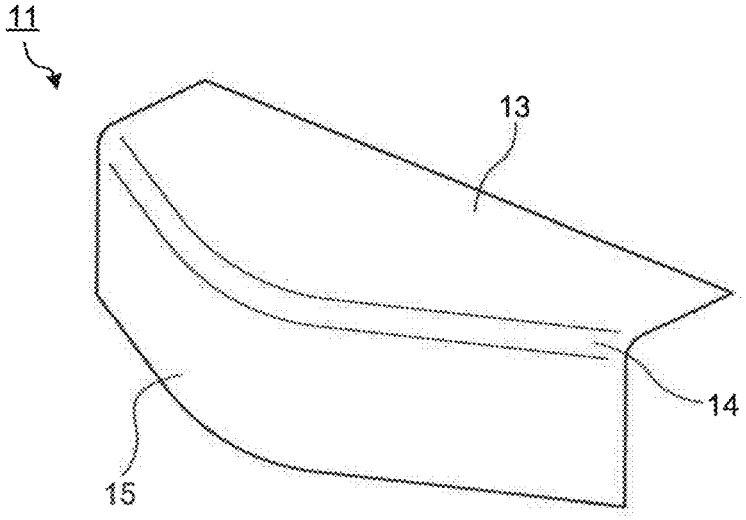
FIG. 2 is a perspective view of an example of a press-formed product according to the present invention.
Figure 3:
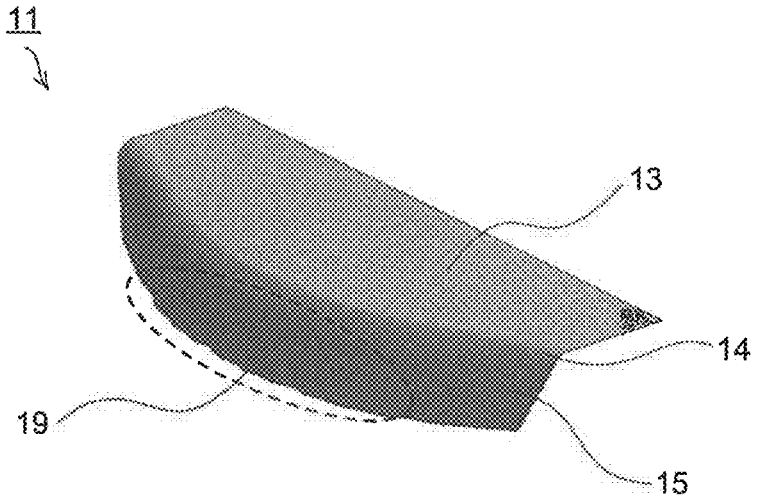
FIG. 3 is a perspective view of an example of a press-formed product formed by using a conventional tool of press forming.

In a press forming method according to a first embodiment of the present invention, as illustrated in FIG. 2, a press-formed product 11 having no flange portion is formed by performing a crash forming process while using a tool of press forming 1 illustrated in FIG. 1. More specifically, as illustrated in FIG. 2, the press-formed product 11 includes, at least, a top portion 13 and a side wall portion 15 that is continued from the top portion 13 via a connecting portion 14. Either all or a part of the side wall portion 15 curves toward the outside to have a convex shape in a planar view. In the press forming method according to the first embodiment of the present invention, the press-formed product 11 illustrated in FIG. 2 is formed by performing a crash forming process, while using a punch 5, a pad 7, and a die 9 included in the tool of press forming 1, as illustrated in FIG. 1. According to this method, the side wall portion 15 of the press-formed product 11 is formed by constantly keeping a tip end portion of a blank 3 in contact with the die 9 in such a manner that, in a side wall forming portion 9*a*, the die 9 imposes no restraint other than keeping the tip end portion in contact therewith. The reasons why the press forming method according to the first embodiment is able to prevent the occurrence of wrinkles in the side wall portion 15 will be explained in detail with reference to FIGS. 2 to 4.

In a case where the press-formed product 11 having the side wall portion 15 that curves toward the outside to have a convex shape in a planar view as illustrated in FIG. 2 is manufactured by performing a conventional crash forming process, when the height of the side wall portion 15 of the press-formed product 11 is equal to or greater than a certain level, wrinkles 19 occur (see FIG. 3), because a shrink deformation is concentrated at a lower end of the side wall portion 15. It is considered that the wrinkles occur due to a mechanism which is explained below.

During the crash forming process to form the side wall portion 15 curving toward the outside to have a convex shape in a planar view, when a deformation process is performed so as to shorten the linear length without buckling of the tip end portion of the blank 3 (see FIG. 1) corresponding to the lower end of the side wall portion 15, the deformation at the tip end portion requires shrink deformation energy in an in-plane direction as well as deformation energy to increase the thickness.

However, when a deformation process is performed in an off-plane direction so as to cause the tip end portion of the blank 3 to buckle while the reduction of the linear length is inhibited, if the sum of the shrink deformation energy and the thickness increasing deformation energy in the in-plans direction and bending deformation energy in the off-plane direction is less than the sum of the shrink deformation energy and the thickness increasing deformation energy in the in-plane direction that do not cause the tip end portion to buckle, the tip end portion is deformed to buckle. As a result, the wrinkles occur toward the outside at the lower end of the side wall portion 15.

To cope with this situation, when the press-formed product 11 is formed so as to have a desired shape of the present invention, it is possible to prevent wrinkles from occurring on the outside, by arranging the die 9 to press the tip end portion of the blank 3 so as not to spread outwardly, as illustrated in FIG. 1.

Figure 4:
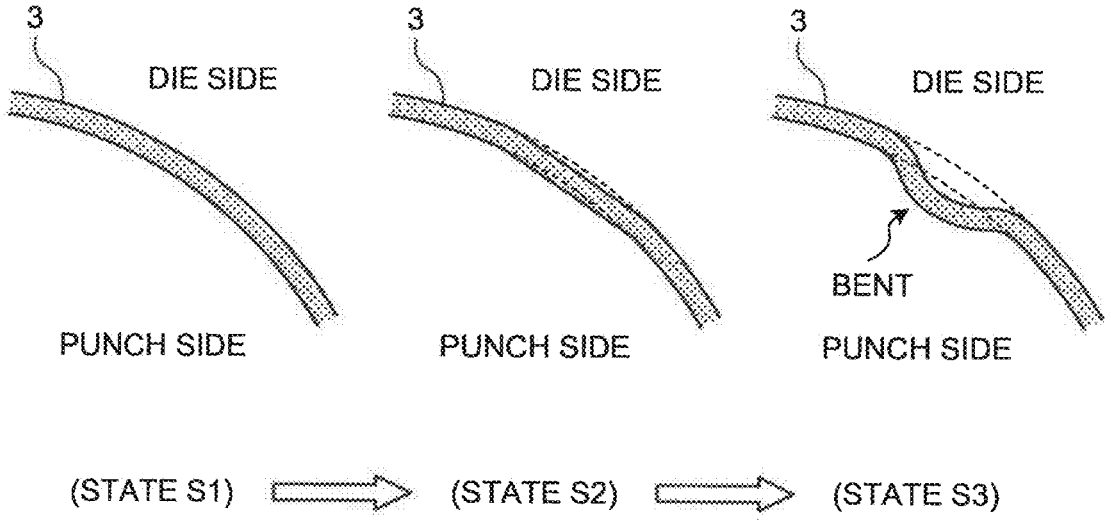
FIG. 4 is a drawing for explaining a deformation behavior exhibited at a tip end portion of a blank during a press forming process.

In this situation, when the forming process is performed, while the tip end portion of the blank 3 is pressed on the outside thereof, there is a possibility that the tip end portion may be bent toward the inside thereof. FIG. 4 illustrates a horizontal cross-section (a cross-section of the blank 3 sectioned in a direction parallel to the plane of the top portion 13 illustrated in FIG. 3) of the blank 3 used in the tip end portion of the side wall portion 15 of the press-formed product 11. In order for the tip end portion of the blank 3 in a state S1 illustrated in FIG. 4 to go into a state S3 illustrated in FIG. 4 during the forming step where the tip end portion of the blank 3 is deformed inwardly in terms of the off-plane direction by being bent inwardly, it would be necessary for the tip end portion to once go through a state S2 illustrated in FIG. 4 where the linear length is slightly shorter. However, from the aspect of deformation energy, a deformation to reach the state S2 illustrated in FIG. 4 where the tip end portion is bent inwardly so as to have a slightly shorter linear length has an extremely small possibility of occurring, compared to the shrink deformation in an in-plane direction. In other words, even when the die 9 is arranged to press down the tip end portion of the blank 3 from the outside thereof, the possibility of the blank 3 being bent inwardly and having wrinkles is extremely small.

As explained above, by forming the tip end portion of the blank 3 by arranging the die 9 to press down the tip end portion of the blank 3 from the outside thereof and to keep the tip end portion in contact therewith, while the die 9 imposes no restraint other than keeping the tip end portion in contact therewith, it is possible to prevent the tip end portion from being deformed outwardly and to prevent the occurrence of wrinkles in the tip end portion. Further, the state where the wrinkles can easily occur toward the outside remains from a certain point in time during the forming process, up to the end of the forming process. It is therefore necessary to constantly keep the tip end portion of the blank 3 in contact with the die 9, so as to press down the tip end portion from the outside thereof.

As an example of the forming method in which the tip end portion of the blank 3 is constantly kept in contact with the die 3, there is a method in which, as described in a second embodiment later, the cross-sectional shape of the side wall forming portion 9*a* of the die 9 is devised.

The first embodiment presents the press forming method in which the crash forming process is performed while the top face of the blank 3 is being pressed by the pad 7 as illustrated in FIG. 1. It should be noted that, however, even when a forming process is performed without arranging the pad 7 to press the blank 3, it is possible to form the side wall portion 15 in such a manner that the side wall portion 15 of the press-formed product 11 has no wrinkles, as long as the tip end portion of the blank 3 is constantly kept in contact with the side wall forming portion 9*a* of the die 9 during the forming process in such a manner that no restraint is imposed on the tip end portion of the blank 3 other than keeping the tip end portion in contact.

It is sufficient when the tip end portion of the blank 3 kept in contact with the side wall forming portion 9*a* of the die 9 during the forming process corresponds to an extent from the tip end of the blank 3 defined by a distance up to four times longer than the thickness of the blank 3, as described in the first example below. When this condition is satisfied, it is possible to form the side wall portion 15 in such a manner that the side wall portion 15 has no wrinkles.

Second Embodiment

A tool of press forming 1 according to the second embodiment will be explained, with reference to FIG. 1 illustrating a state during the forming process. The tool of press forming 1 according to the second embodiment of the present invention includes, at least, the top portion 13 and the side wall portion 15 that is continued from the top portion 13 via the connecting portion 14, as illustrated in FIG. 2 similar to the first embodiment explained above, so as to form the press-formed product 11 in which either all or a part of the side wall portion 15 curves toward the outside to have a convex shape in a planar view. As illustrated in FIG. 1, the tool of press forming 1 includes: the punch 5 that supports the lower face of the blank 3 that is tabular-shaped; the pad 7 that presses the top face of the blank 3 supported by a forming top portion 5*a* of the punch 5; and the die 9 that performs a bending process while the side wall forming portion 9*a* thereof abuts against the blank 3 held between the punch 5 and the pad 7.

<Punch>

The punch 5 includes: the forming top portion 5*a*; a punch shoulder portion 5*b* that is a shoulder portion of the punch which continues downward at an angle from an end of the forming top portion 5*a*; and a forming wall portion 5*c* that continues downward from a lower end side of the punch shoulder portion 5*b*. The forming top portion 5*a* supports the lower face of the blank 3, which is a flat face. Further, the cross-sectional shape of the punch shoulder portion 5*b* is an arc having a radius curvature R.

<Pad>

The pad 7 is arranged so as to oppose the forming top portion 5*a* of the punch 5 and is configured so as to be raised and lowered. By placing the blank 3 on the forming top portion 5*a* of the punch 5 and pressing the blank 3 by moving the pad 7 toward the punch 5 side, it is possible to arrange the blank 3 to be held between the punch 5 and the pad 7.

<Die>

Figure 5:
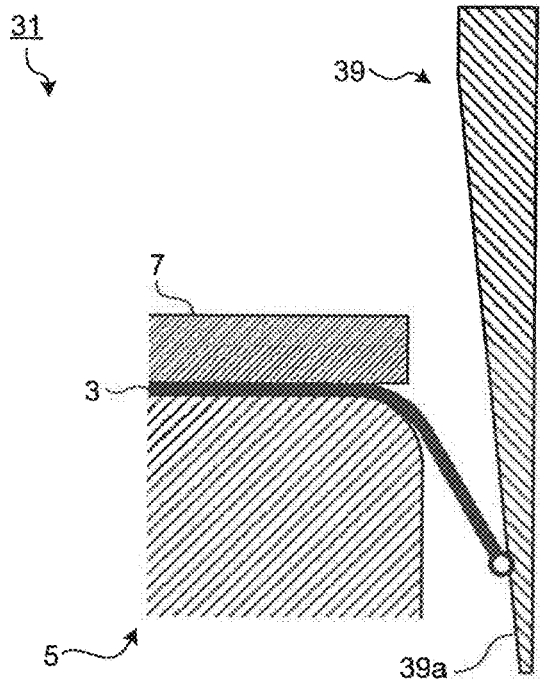
FIG. 5 is a cross-sectional view of an example of a tool of press forming in which a side wall forming portion of a die has a flat inclined surface according to the present invention.

The die 9 performs the bending deformation process on the blank 3 while abutting against the blank 3 and includes the side wall forming portion 9*a* that forms the side wall portion 15 of the press-formed product 11. The cross-sectional shape of the side wall forming portion 9*a* is curved as illustrated in FIG. 1. Because the cross-sectional shape of the side wall forming portion 9*a* is arranged to be curved, it is possible to constantly keep the tip end portion of the blank 3 in contact with the side wall forming portion 9*a* during the forming process. Alternatively, as explained later, by using a die 39 that has a side wall forming portion 39*a* of which the cross-sectional shape is a straight line as illustrated in FIG. 5, it is also possible to constantly keep the tip end portion of the blank 3 in contact with the side wall forming portion 39*a* during the forming process.

Next, a requirement for the cross-sectional shape of the side wall forming portion 9*a* of the die 9 to constantly keep the tip end portion of the blank 3 in contact with the die 9 will be explained with reference to FIGS. 6 to 9. In FIGS. 6 to 9, some of the sections that are the same as, or that correspond to, those in FIG. 1 will be referred to by using the same reference signs.

Figure 6:
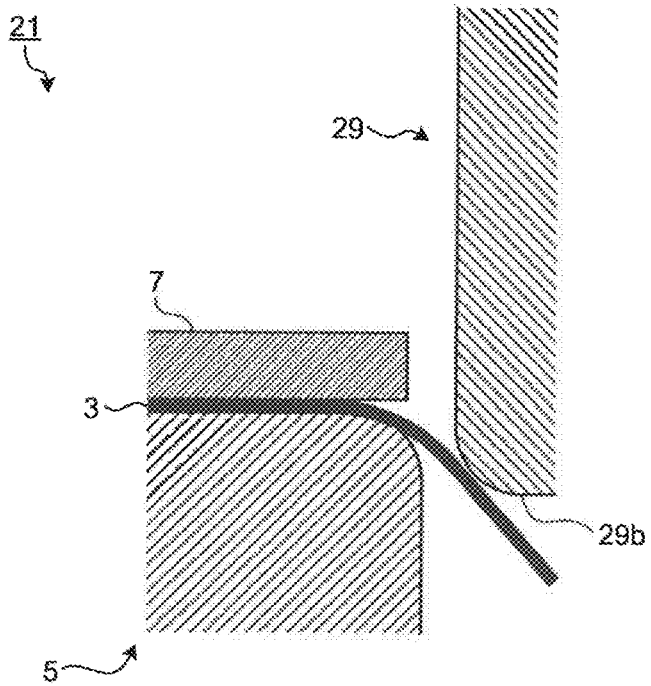
FIG. 6 is a drawing for explaining a conventional tool of press forming.

When a press-formed product having a top portion, a side wall portion, and a flange portion is formed by performing a press forming process, while using a conventional tool of press forming 21 including the punch 5, the pad 7, and a die 29 as illustrated in FIG. 6, the cross-sectional shape of a die shoulder portion 29*b* is determined by the cross-sectional shape of a connecting portion connecting together the side wall portion and the flange portion of the press-formed product.

In contrast, when the press-formed product 11 having no flange portion as targeted by the present invention is formed by performing a press forming process while using the conventional tool of press forming 21, it is possible for the die shoulder portion 29*b* to have any cross-sectional shape regardless of the shape of the product resulting from the forming process of the press-formed product 11, except that the press-formed product 11 may have a forming defect such as a crack or wrinkles after the press forming process.

Thus, while a focus is placed on the aspect described above, an analysis was performed on the cross-sectional shape of the side wall forming portion 9*a* to constantly keep the tip end of the blank 3 in contact with the die 9 during the forming process. First, an analysis was performed on an example as illustrated in FIG. 7 in which the side wall forming portion 9*a* of the die 9 has an inclined surface of which the inclination angle is constant.

Figure 7:
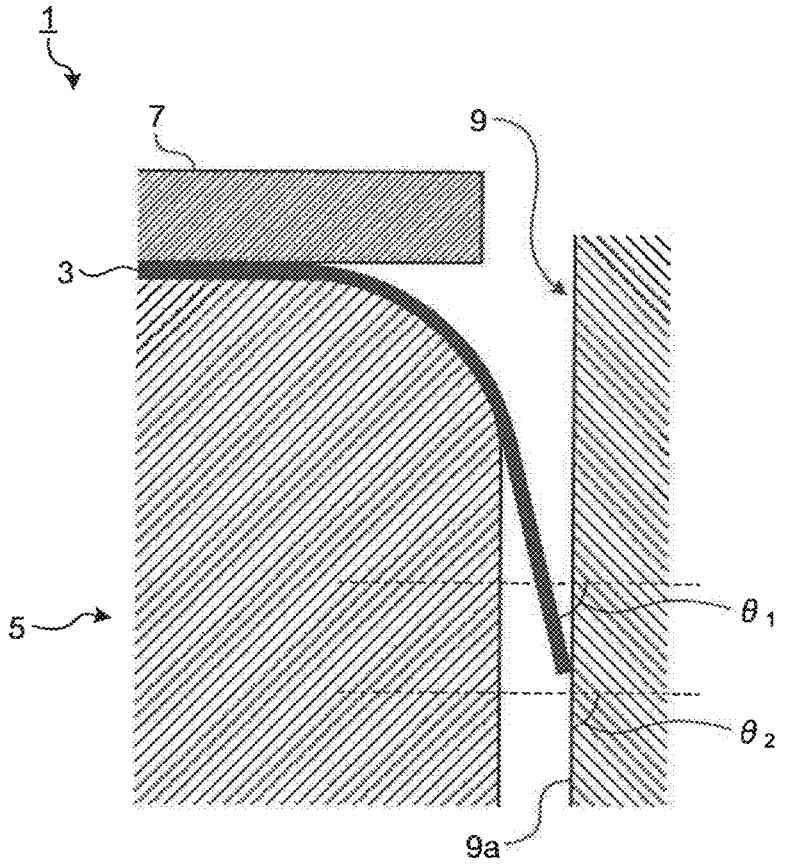
FIG. 7 is a drawing for explaining a cross-sectional shape of a tool of press forming used by a press forming method according to the second embodiment of the present invention.

When the side wall forming portion 9*a* of the die 9 is structured to have the inclined surface of which the inclination angle is constant as illustrated in FIG. 7, performing the forming process while constantly keeping the tip end of the blank 3 in contact with the die 9 requires that an inclination angle $\theta_2$ of the inclined surface representing the side wall forming portion 9*a* of the die 9 with respect to the horizontal direction be equal to or greater than an inclination angle $\theta_1$, with respect to the horizontal direction, of the section positioned in the vicinity of the tip end of the blank 3 at the bottom dead point of the forming process, i.e., of the side wall portion 15 of the press-formed product 11. However, when the inclination angle $\theta_2$ of the inclined surface of which the inclination angle is constant as described above was determined to have a constant value that is equal to or greater than the inclination angle $\theta_1$ formed by the section positioned in the vicinity of the tip end of the blank 3 (see FIG. 7), applying a bending deformation process to the blank 3 down to the bottom dead center of the forming process would require that the inclination angle $\theta_2$ of the inclined surface be close to 90 degrees because the side wall portion 15 is approximately perpendicular. It would therefore be necessary to determine the forming stroke of the die 9 to be extremely long.

However, the inclination angle, with respect to the horizontal direction, of the tip end of the blank 3 corresponding to the side wall portion 15 of the press-formed product 11 varies during the forming process. Thus, the inventors of the present application have discovered that it is possible to constantly keep the tip end of the blank 3 in contact with the side wall forming portion 9*a* without the need to determine the forming stroke to be long, by arranging the cross-sectional shape of the side wall forming portion 9*a* to be a cross-sectional shape expressed by a curve where the inclination angle of the side wall forming portion 9*a* with respect to the horizontal direction changes in accordance with the position in which the tip end of the blank 3 is in contact with the die 9 during the forming process.

Figure 8:
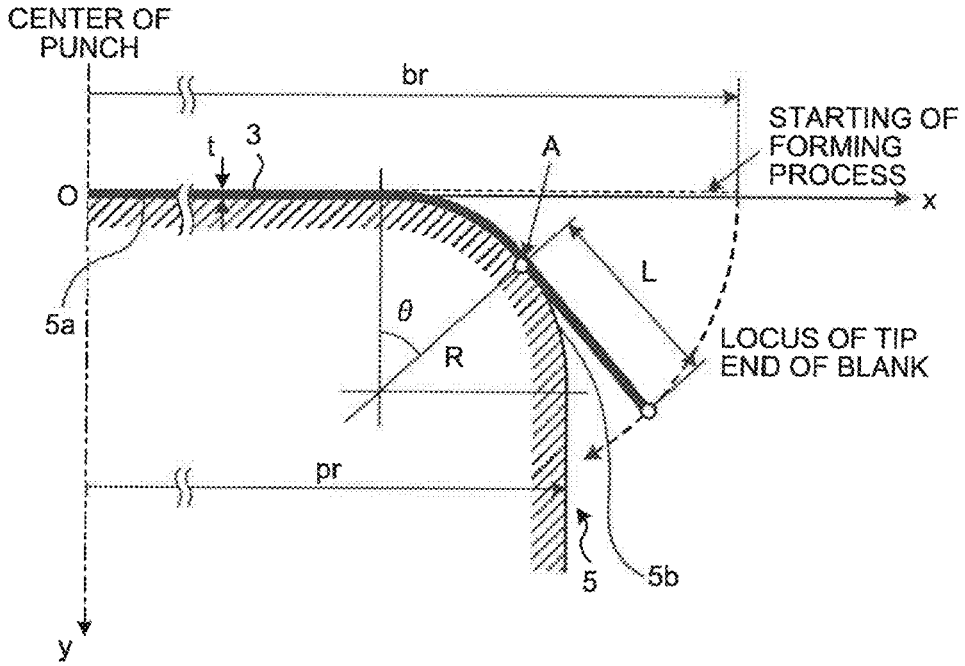
FIG. 8 is a drawing for explaining a locus of the tip end of a blank during a press forming process according to the second embodiment of the present invention.

The specific cross-sectional shape in which the inclination angle of the side wall forming portion 9*a* with respect to the horizontal direction changes was determined in the following manner. As illustrated in FIG. 8, the radius of the punch (hereinafter referred to as "punch radius") on a plane parallel to the horizontal direction of the forming top portion 5*a* of the punch 5 is expressed as "pr" [mm], while the radius curvature of the punch shoulder portion 5*b* is expressed as "R" [mm], and the radius of the blank 3 (hereinafter referred to as "blank radius") on a plane parallel to the horizontal direction of the forming top portion 5*a* is expressed as "br" [mm], whereas the thickness of the blank 3 is expressed as "t" [mm]. In that situation, a distance L from the point (the point A in FIG. 8) where the blank 3 becomes apart from the punch shoulder portion 5*b* as a result of the bending deformation process performed thereon while the blank 3 abutting against the punch shoulder portion 5*b*, to the tip end of the blank 3 can be expressed by using the formula presented below, where the contact angle "θ" [rad] of the blank 3 with respect to the punch shoulder portion 5*b* is used as a parameter.

$$L = br - (pr - R) - \left(R + \frac{t}{2}\right)\theta$$

Accordingly, it is possible to express a locus of the tip end position of the blank 3 during the forming process as a point (x, y) expressed by the following formula in an x-y coordinate system in which the origin O is the point serving as the center of the radius curvature of the curve in the horizontal direction on the forming top portion 5*a*, while the x-axis corresponds to the horizontal direction of the forming top portion 5*a*, whereas the y-axis corresponds to the vertical direction of the forming top portion 5*a*.

$$\left.\begin{aligned} x &= pr - R + (R + t)\sin\theta + \left\{br - (pr - R) - \left(R + \frac{t}{2}\right)\theta\right\}\cos\theta \\ y &= (R + t)\cos\theta - \left\{br - (pr - R) - \left(R + \frac{t}{2}\right)\theta\right\}\sin\theta - R \end{aligned}\right\}$$

Figure 9:
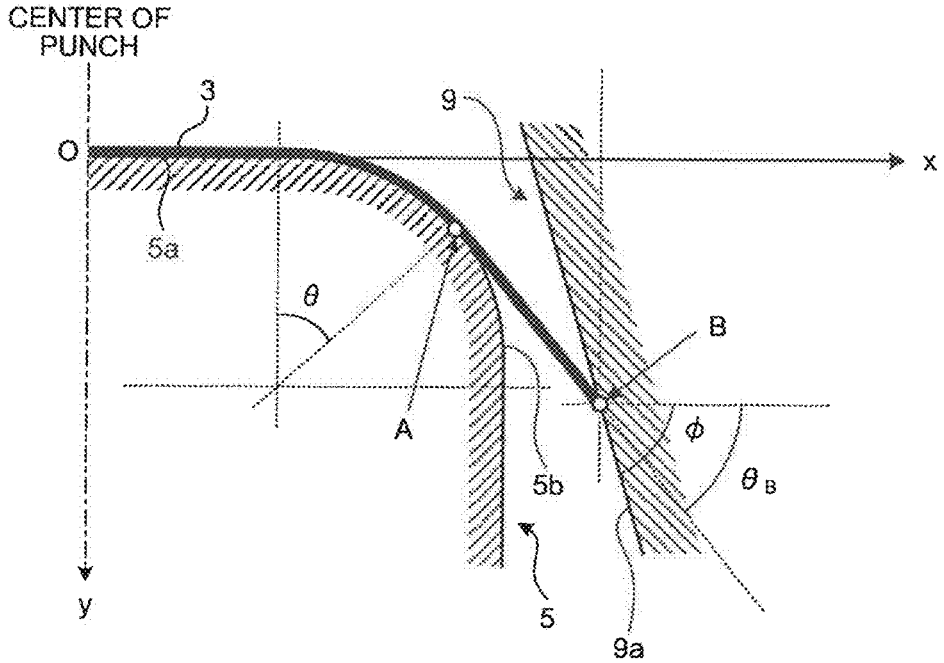
FIG. 9 is a drawing for explaining a deformation of a blank and an inclination angle of a side wall forming portion of a die with respect to a horizontal direction according to the second embodiment of the present invention.

As illustrated in FIG. 9, the angle $\theta_B$ formed by the horizontal direction and the direction parallel to the section of the blank 3 at the tip end of the blank 3 kept in contact with the side wall forming portion 9*a* is equal to the contact angle θ of the blank 3 with respect to the punch shoulder portion 5*b*. Accordingly, in order for the side wall forming portion 9*a* of the die 9 to have a cross-sectional shape so as to be constantly kept in contact with the tip end of the blank 3, it is necessary that the inclination angle ϕ indicating the angle of the side wall forming portion 9*a* with respect to the horizontal direction at the point (the point B in FIG. 9) where the tip end of the blank 3 is kept in contact be equal to or greater than the angle $\theta_B$ at all times. It is therefore necessary that the contact angle θ of the blank 3 with respect to the punch shoulder portion 5*b* and the inclination angle ϕ satisfy the relationship expressed in Expression (1) presented below:

$$\theta \leq \phi \tag{1}$$

Accordingly, when the user wishes to keep the height of the side wall forming portion 9*a*, i.e., the forming stroke as short as possible, the inclination angle ϕ should be the smallest, i.e., the condition θ=ϕ should be satisfied.

Consequently, in an X-Y coordinate system in which the origin O is the point serving as the center of the radius curvature of the aforementioned curve in the horizontal direction on the forming top portion 5*a* of the punch 5, while the X-axis corresponds to the horizontal direction of the forming top portion 5*a*, whereas the Y-axis corresponds to the vertical direction of the forming top portion 5*a*, when the coordinates of the surface of the side wall forming portion 9*a* are expressed as "(X, Y)", the Y component decreases when the inclination angle ϕ becomes equal to the contact angle θ as the X component increases, with respect to the coordinates (X, Y) indicating the surface of the side wall forming portion 9*a*. Consequently, it is possible to determine an optimal cross-sectional shape of the side wall forming portion 9*a* by satisfying the relationship expressed in the formula presented below.

$$dY/dX = -\tan\theta$$

Consequently, it is possible to express the optimal cross-sectional shape of the side wall forming portion 9*a* in the X-Y coordinate system described above, by using an optimal curve drawn by the formula presented below.

$$\left.\begin{aligned} X &= x = pr - R + (R + t)\sin\theta + \left\{br - (pr - R) - \left(R + \frac{t}{2}\right)\theta\right\}\cos\theta \\ Y &= \int_0^{\theta} (-\tan\theta)dX \end{aligned}\right\}$$

By simplifying the above formula, it is possible to express the optimal curve indicating the optimal cross-sectional shape of the side wall forming portion 9*a* by using Expression (2) presented below.

$$\left.\begin{aligned} X &= pr - R + (R + t)\sin\theta + \left\{br - (pr - R) - \left(R + \frac{t}{2}\right)\theta\right\}\cos\theta \\ Y &= -\int_0^{\theta} \left[\frac{t}{2}\sin\theta - \left\{br - (pr - R) - \left(R + \frac{t}{2}\right)\theta\right\}\sin\theta\tan\theta\right]d\theta \end{aligned}\right\} \tag{2}$$

Figure 10:
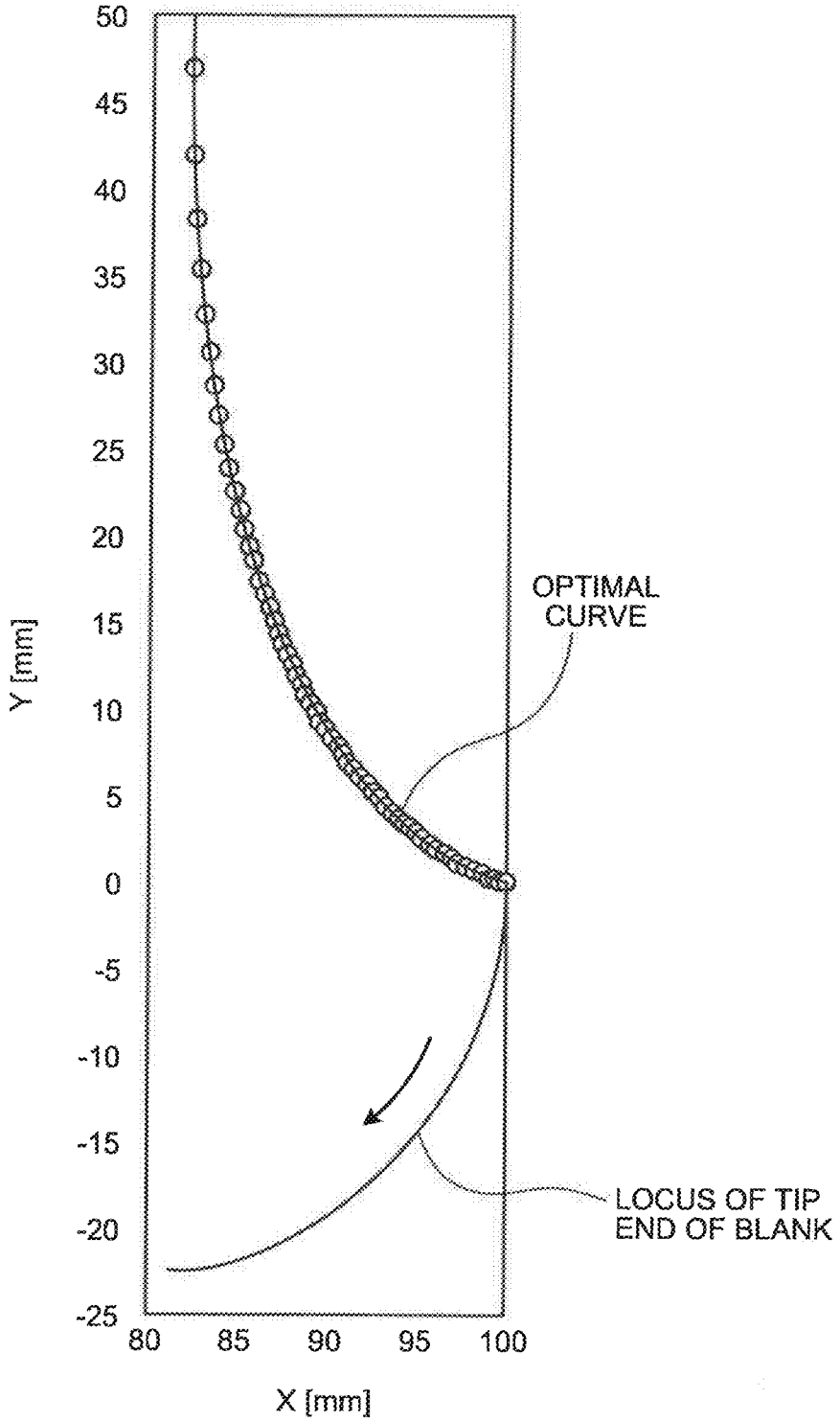
FIG. 10 is a chart illustrating a locus of the tip end of a blank and an example of a calculation result of an optimal curve.

FIG. 10 illustrates, as an example, a locus of the tip end of the blank 3 and an optimal curve obtained by calculating numerical values of the contact angle θ [rad] in the range of $0 \leq \theta \leq \pi/2$ with increments of $\pi/180$, while the punch radius satisfies pr=80 [mm], the radius curvature of the punch shoulder portion 5*b* satisfies R=5 [mm], the blank radius satisfies br=100 [mm], and the thickness of the blank 3 satisfies t=1.2 [mm].

Figure 11:
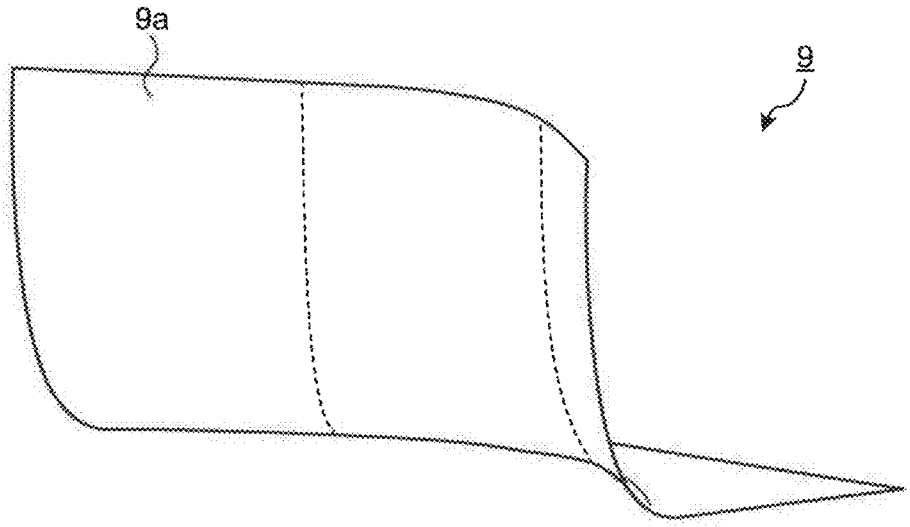
FIG. 11 is a perspective view illustrating an example of a side wall forming portion of a die of a tool of press forming according to the second embodiment of the present invention.

As explained above, by calculating the optimal curve while giving values to the parameters presented in Expression (2), it is possible to determine the optimal cross-sectional shape of the side wall forming portion 9*a*. By arranging the side wall forming portion 9*a* to have the optimal cross-sectional shape, it is possible to prevent the forming stroke from increasing, while constantly having the tip end of the blank 3 abut against the side wall forming portion 9*a*. FIG. 11 illustrates an example of the side wall forming portion 9*a* having the optimal cross-sectional shape determined by using the method described above.

Further, when the inclination angle of the tangential line of the optimal curve with respect to the horizontal direction in an arbitrary X-coordinate position within in the X-Y coordinate system described above is referred to as an "optimal inclination angle", the condition defined in Expression (1) is satisfied at all times during the forming process, as long as the cross-sectional shape of the side wall forming portion 9*a* is such a cross-sectional shape (hereinafter referred to as a "tolerable cross-sectional shape") that is expressed with a curve where the inclination angle of the tangential line at the arbitrary X-coordinate position with respect to the horizontal line is equal to or greater than the optimal inclination angle. Consequently, during the forming process, the bending deformation process is performed while the tip end of the blank 3 is constantly kept in contact with the side wall forming portion 9*a*. It is therefore possible to prevent the occurrence of wrinkles in the side wall portion of the press-formed product.

Figure 12A:
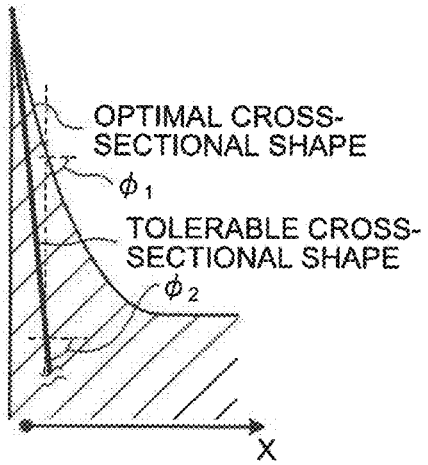
FIG. 12A is a drawing for explaining Example 1 of a tolerable cross-sectional shape of the side wall forming portion according to the second embodiment of the present invention.
Figure 12B:
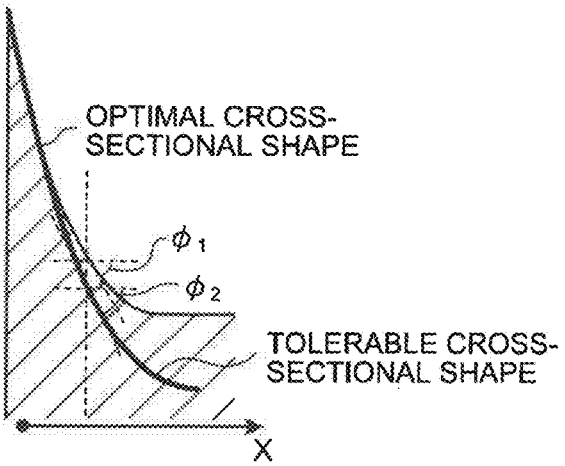
FIG. 12B is a drawing for explaining Example 2 of a tolerable cross-sectional shape of the side wall forming portion according to the second embodiment of the present invention.
Figure 12C:
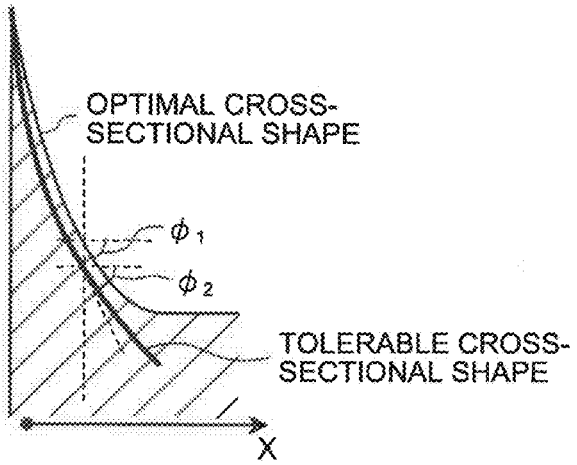
FIG. 12C is a drawing for explaining Example 3 of a tolerable cross-sectional shape of the side wall forming portion according to the second embodiment of the present invention.

FIGS. 12A to 12C are drawings that illustrate examples of tolerable cross-sectional shapes of the side wall forming portion 9*a* that satisfy Expression (1). It is assumed that the tip end of the blank 3 is, without fail, in contact with the side wall forming portion 9*a* at the start of the press forming process.

FIG. 12A illustrates Example 1 of the tolerable cross-sectional shape of the side wall forming portion 9*a*. The tolerable cross-sectional shape in Example 1 is a tolerable cross-sectional shape expressed with an inclined surface of which the inclination angle $\phi_2$ is constant. In Example 1, as illustrated in FIG. 12A, the inclination angle $\phi_2$ is greater than the optimal inclination angle $\phi_1$. FIG. 12B illustrates Example 2 of the tolerable cross-sectional shape of the side wall forming portion 9*a*. The tolerable cross-sectional shape in Example 2 is a tolerable cross-sectional shape obtained by applying analogous enlargement to the optimal cross-sectional shape. As illustrated in FIG. 12B, in an arbitrary X-coordinate position, the inclination angle $\phi_2$ of the tangential line of the curve expressing the tolerable cross-sectional shape in Example 2 with respect to the horizontal direction is greater than the optimal inclination angle $\phi_1$. FIG. 12C illustrates Example 3 of the tolerable cross-sectional shape of the side wall forming portion 9*a*. The tolerable cross-sectional shape in Example 3 is a tolerable cross-sectional shape expressed with an arc having a large radius curvature. In Example 3, as illustrated in FIG. 12C, the inclination angle $\phi_2$ of the tangential line of the arc at an arbitrary X-coordinate position is greater than the optimal inclination angle $\phi_1$.

Consequently, the cross-sectional shape of the side wall forming portion 9*a* satisfies the condition defined in Expression (1) in any of the examples illustrated in FIGS. 12A to 12C. It is therefore possible to perform the bending deformation process while constantly keeping the tip end of the blank 3 in contact with the side wall forming portion 9*a*.

Figure 13A:
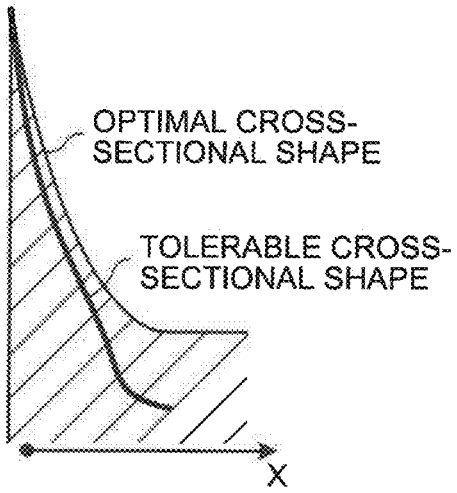
FIG. 13A is a drawing for explaining another example of a tolerable cross-sectional shape of the side wall forming portion according to the second embodiment of the present invention.

Alternatively, as long as the condition defined in Expression (1) is satisfied at an arbitrary X-coordinate position, the cross-sectional shape of the side wall forming portion 9*a* may be a tolerable cross-sectional shape that is expressed, as illustrated in FIG. 13A, with a curve where the inclination angle $\phi_2$ (not illustrated in FIG. 13A) of the tangential line at the arbitrary X-coordinate position with respect to the horizontal direction decreases in an intermediate section.

Figure 13B:
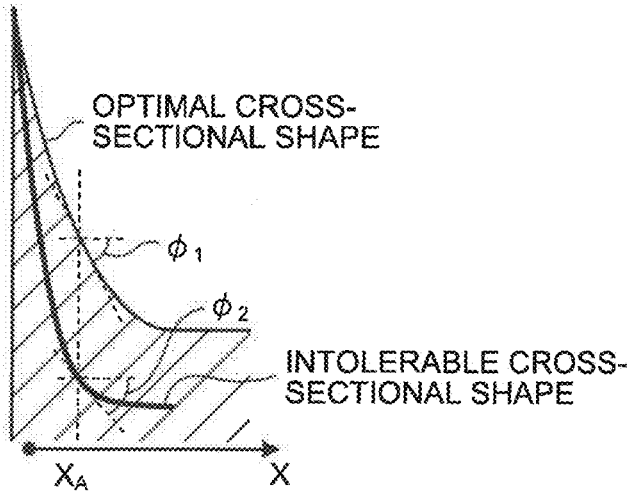
FIG. 13B is a drawing for explaining an example of an intolerable cross-sectional shape of the side wall forming portion according to the second embodiment of the present invention.

However, when the cross-sectional shape of the side wall forming portion 9*a* is a cross-sectional shape that is expressed, as illustrated in FIG. 13B for example, with a curve where the inclination angle $\phi_2$ of the tangential line at a certain X-coordinate position $X_A$ is less than the optimal inclination angle $\phi_1$, the condition defined in Expression (1) is not satisfied. Such cross-sectional shapes that do not satisfy the condition defined in Expression (1) are intolerable cross-sectional shapes that are not tolerable for the side wall forming portion 9*a*. When the cross-sectional shape of the side wall forming portion 9*a* is an intolerable cross-sectional shape, a section other than the tip end of the blank 3 comes into contact with the side wall forming portion 9*a*. Thus, it is not desirable when the side wall forming portion 9*a* has a cross-sectional shape such as that illustrated in FIG. 13B. It should be noted that, however, when the cross-sectional shape of the side wall forming portion 9*a* is such a shape that the extent from the tip end of the blank 3 defined by a distance up to four times longer than the thickness of the blank 3 is constantly kept in contact with the side wall forming portion 9*a* during the side wall forming process, it is possible to prevent the occurrence of wrinkles.

Also, by applying the tool of press forming 1 of the present invention to a forming process performed on a blank having a smaller radius (hereinafter referred to as a "smaller blank 43") than the blank radius br of the blank (hereinafter referred to as a "basic blank 41") used for calculating the optimal cross-sectional shape of the side wall forming portion 9*a*, it is also possible to prevent the occurrence of wrinkles. This aspect will be explained below, with reference to FIGS. 14A and 14B.

Figure 14A:
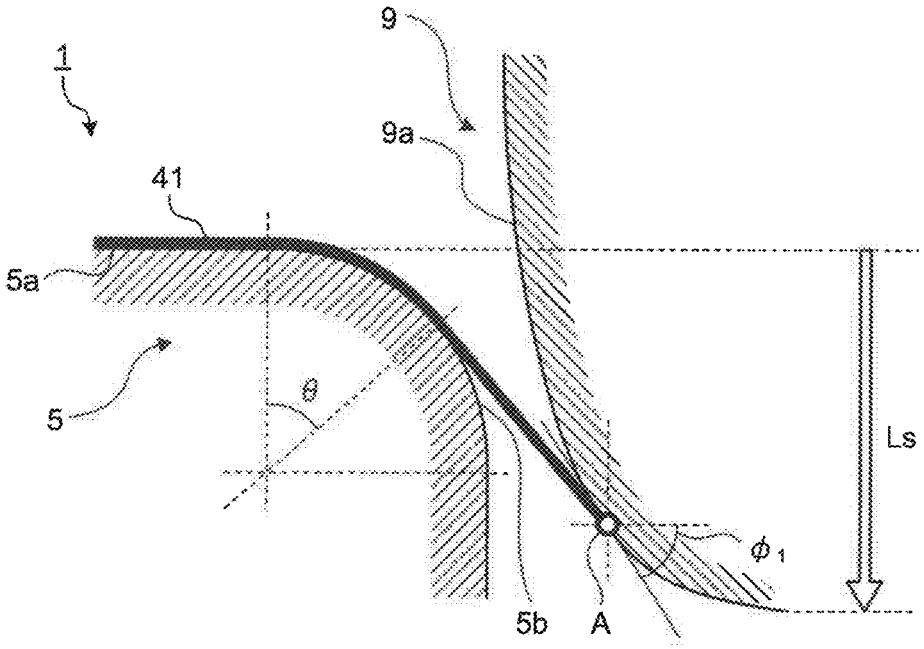
FIG. 14A is a drawing for explaining an example of the size of a blank according to the second embodiment of the present invention.
Figure 14B:
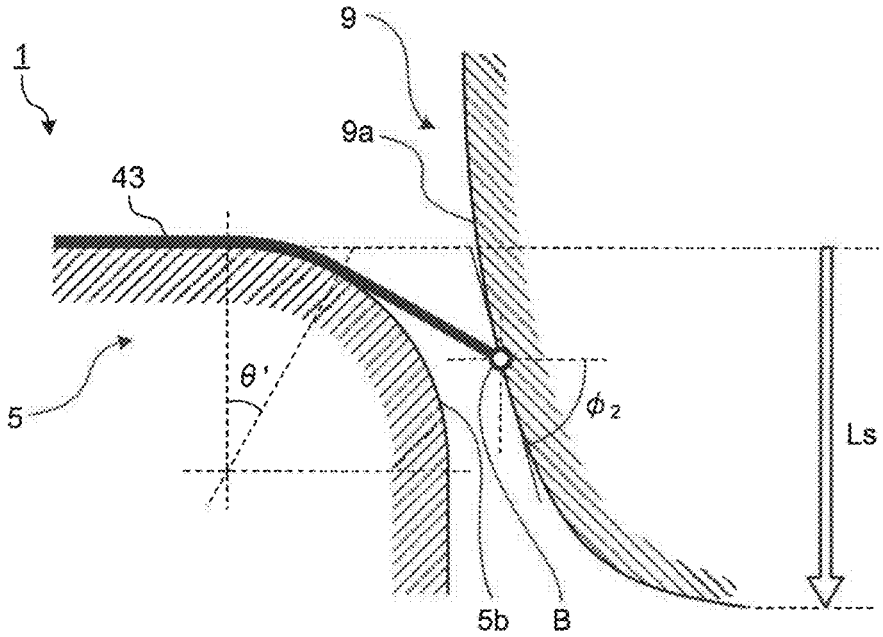
FIG. 14B is a drawing for explaining another example of the size of a blank according to the second embodiment of the present invention.

As illustrated in FIG. 14A, during the forming process performed on the basic blank 41 while using the tool of press forming 1, the contact angle of the basic blank 41 with respect to the punch shoulder portion 5*b* is expressed as "θ", when the moving distance of the die 9 is expressed as "Ls", while using the height of the forming top portion 5*a* of the punch 5 as a reference. Further, the inclination angle of the tangential line of the die 9 with respect to the horizontal direction at the point (the point A in FIG. 14A) where the tip end of the basic blank 41 is in contact with the side wall forming portion 9*a* is expressed as "$\phi_1$". Similarly, as illustrated in FIG. 14B, during the forming process performed on the smaller blank 43 while using the tool of press forming 1, the contact angle of the smaller blank 43 with respect to the punch shoulder portion 5*b* is expressed as "θ'", when the moving distance of the die 9 toward the punch 5 side is expressed as "Ls". Further, the inclination angle of the tangential line of the die 9 with respect to the horizontal direction at the point (the point B in FIG. 14B) where the tip end of the smaller blank 43 is in contact with the side wall forming portion 9*a* is expressed as "$\phi_2$".

As illustrated in FIGS. 14A and 14B, the contact angle θ' of the smaller blank 43 is less than the contact angle θ of the basic blank 41 at all times, regardless of the value of the moving distance Ls of the die 9. Further, the inclination angle $\phi_2$ of the tangential line of the die 9 at the point where the tip end of the smaller blank 43 is in contact with the side wall forming portion 9*a* is greater than the contact angle θ'. Accordingly, when a forming process is performed on the smaller blank 43 by using the die 9 having the side wall forming portion 9*a* of which the cross-sectional shape is determined on the basis of the basic blank 41, the relationship defined in Expression (1) is always satisfied. Consequently, because the forming process is performed while the tip end of the smaller blank 43 is constantly kept in contact with the side wall forming portion 9*a*, it is possible to prevent the occurrence of wrinkles. It should be noted that, however, for the purpose of keeping the smaller blank 43 in contact with the die 9 from the start of the press forming process, it is necessary that the radius of the smaller blank 43 is greater than the punch radius.

In this situation, the section in which the cross-sectional shape of the side wall forming portion 9*a* of the die 9 is determined in the manner described above may be applied to only a target section for which the occurrence of wrinkles is to be prevented in the side wall portion 15 of the press-formed product 11. Alternatively, the cross-section determination process may be whole of the side wall portion 15.

Further, even when the radius curvature of the side wall portion 15 curving toward the outside to have a convex shape in a planar view is not constant throughout the whole of the side wall portion 15, it may be a good idea to design the die 9, by dividing the side wall portion 15 into sections in each of which the radius curvature of the curve is the same, determining a cross-sectional shape of the side wall forming portion 9*a* of the die 9 for each of the divided sections by using the method described above, and joining together the cross-sectional shapes determined for the divided sections to form the side wall forming portion 9*a*.

First Example

An experiment was conducted to verify that it is possible to prevent the occurrence of wrinkles in the side wall portion curving toward the outside of the press-formed product to have a convex shape in a planar view, by using the press forming method and the tool of press forming according to the present invention so as to form the side wall portion of the press-formed product by constantly keeping the tip end portion of the blank corresponding to an extent from the tip end of the blank defined by a distance up to four times longer than the thickness of the blank in contact with the side wall forming portion of the die, while no restraint was imposed on the tip end portion of the blank other than keeping the tip end portion in contact. The experiment will be explained below.

Figure 15:
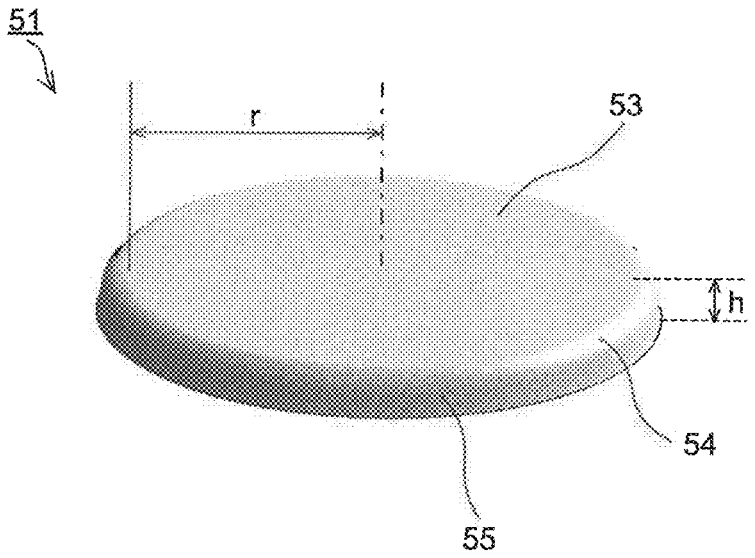
FIG. 15 is a drawing for explaining a press-formed product discussed in a first example and a third example.

A first example corresponds to a situation where a crash forming process is performed to form a press-formed product 51 that has a side wall portion 55 continued from a disc-shaped top portion 53 via a connecting portion 54 illustrated in FIG. 15. As for the dimension of the press-formed product 51, the radius r of the top portion 53 was 90 [mm], while the radius curvature of the connecting portion 54 was 8 [mm]. Further, two types of blanks 3 were used for forming the press-formed product 51, namely, a steel sheet A that had a thickness t of 1.2 [mm] and had a tensile strength of 590 [MPa] grade; and a steel sheet B that had a thickness t of 1.6 [mm] and had a tensile strength of 590 [MPa] grade. Further, to form the press-formed product 51 having the disc-shaped top portion 53, the blank 3 had a disc shape of which the radius (the blank radius) was 105 [mm] for the steel sheet A and was 107 [mm] for the steel sheet B.

To press-form the press-formed product 51 by performing the crash forming process on the blanks 3 having the above specifications, while using the tool of press forming 1 according to the present invention of which the cross-section is illustrated in FIG. 1, the punch radius of the punch 5 was 90 [mm], while the radius curvature of the punch shoulder portion 5*b* was 8 [mm]. The side wall forming portion 9*a* of the die 9 had a cross-sectional shape determined for every millimeter in the range of br=100 [mm] to 105 [mm], while the parameters in the Expression (2) were determined to satisfy pr=90 [mm], R=8 [mm], and t=1.2 [mm].

Because the blank radius of the blank 3 used for the press forming process is 105 [mm], when the side wall forming portion 9*a* has an optimal cross-sectional shape calculated by arranging the blank radius of the blank 3 in Expression (2) to satisfy br=105 [mm], the forming process is performed while only the tip end of the blank 3 is in contact with the side wall forming portion 9*a*. In contrast, when the side wall forming portion 9*a* has a cross-sectional shape determined by using another value br less than the blank radius of the blank 3, the forming process is performed while a tip end portion including a section positioned on the inside of the tip end of the blank 3 is in contact with the side wall forming portion 9*a*. In this situation, the greater the difference is between the blank radius of the blank 3 and the value of br in Expression (2), the greater the extent of the tip end portion that is in contact with the side wall forming portion 9*a* becomes.

Table 1 illustrates results regarding whether wrinkles occurred or not in the side wall portions 55 of the press-formed products 51 and the extent (the distance) "a" of the tip end portion of the blank 3 that was in contact with the side wall forming portion 9*a*, when the crash forming process was performed on the steel sheet A and the steel sheet B under the abovementioned conditions.

TABLE 1

| br [mm] | Extent a [mm] of tip end portion of blank that is in contact with side wall forming portion | a/t [—] | Occurrence of Wrinkles |
|---|---|---|---|
| Steel Sheet A (590 MPa-grade, Thickness 1.2 mm, Blank radius 105 mm) | | | |
| 105 | 0.0 | 0.0 | No |
| 104 | 1.2 | 1.0 | No |
| 103 | 2.4 | 2.0 | No |
| 102 | 3.6 | 3.0 | No |
| 101 | 4.8 | 4.0 | No |
| 100.5 | 5.4 | 4.5 | Yes |
| Steel Sheet B (590 MPa-grade, Thickness 1.6 mm, Blank radius 107 mm) | | | |
| 107 | 0.0 | 0.0 | No |
| 106 | 1.6 | 1.0 | No |
| 105 | 3.2 | 2.0 | No |
| 104 | 4.8 | 3.0 | No |
| 103 | 6.4 | 4.0 | No |
| 102 | 8.0 | 5.0 | Yes |

As indicated in Table 1, it was verified that an advantageous effect of preventing the occurrence of wrinkles in the press-formed products 51 was achieved, with respect to both the steel sheet A and the steel sheet B, when the ratio between the extent (the distance) "a" of the tip end portion and the thickness t of the blank 3 was equal to or less than 4.0 times, because the tip end portion of the blank 3 was pressed down from the outside while being constantly kept in contact with the side wall forming portion 9*a* of the die 9. In other words, by determining the cross-sectional shape of the side wall forming portion 9*a* on the basis of Expression (2) in such a manner that the tip end portion of the blank 3 corresponding to an extent from the tip end of the blank 3 defined by a distance up to four times longer than the thickness is kept in contact with the side wall forming portion 9*a* of the die 9, it is possible to prevent the occurrence of wrinkles in the side wall portion 55, when the press-formed product 51 shaped to curve outward to have a convex shape is formed by performing the crash forming process.

Second Example

In a second example, it was checked to see whether wrinkles occurred or not in the side wall portion 15, when the press-formed product 11 having the side wall portion 15 curving toward the outside to have a convex shape in a planar view as illustrated in FIG. 2 was formed by performing a crash forming process while using the tool of press forming 1 according to the present invention as illustrated in FIG. 1.

Figure 16:
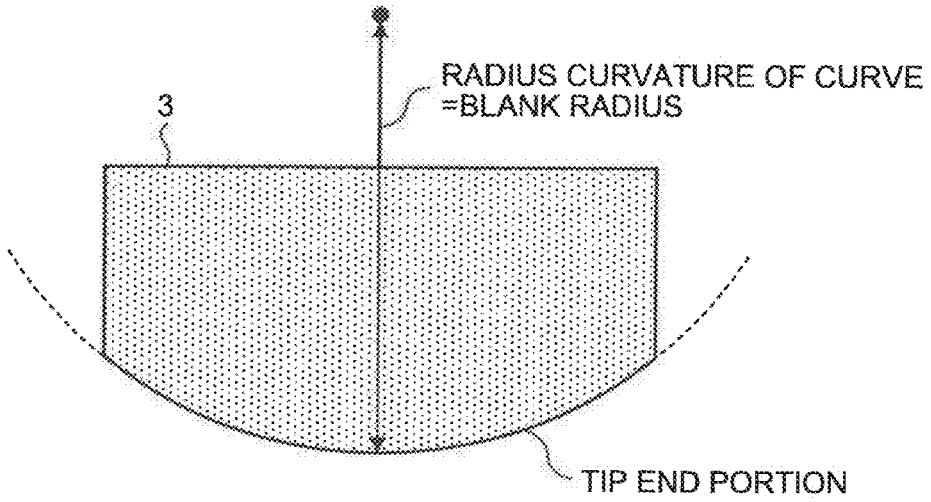
FIG. 16 is a drawing for explaining the shape of a blank used for forming a press-formed product discussed in a second example.

As for the dimension of the press-formed product 11, the radius curvature of the cross-sectional plane of the connecting portion 14 connecting together the top portion 13 and the side wall portion 15 was 5 [mm], while the radius curvature of the curve on a plane parallel to the horizontal direction of the top portion 13 was 80 [mm]. The blank 3 was a steel sheet that had a thickness of 1.2 [mm] and a tensile strength of 980 [MPa] grade. An optimal cross-sectional shape A of the side wall forming portion 9*a* of the die 9 was determined on the basis of the dimensions in the press-formed product 11, while the parameters in Expression (2) were determined to satisfy pr=80 [mm], R=5 [mm], t=1.2 [mm], and br=100 [mm]. As explained in the second embodiment, the blank 3 having such a blank radius that is less than br=100 [mm] and is greater than the punch radius pr of the punch 5 falls within the scope of the present invention. The blank radius of the blank 3 denotes, as illustrated in FIG. 16, the radius curvature of the curve at the tip end portion of the blank 3.

The second example corresponds to situations where, in addition to the tool of press forming 1 (Example 1 of the present invention) including the die 9 having the side wall forming portion 9*a* with the optical cross-sectional shape A described above, a tool of press forming 31 (Example 2 of the present invention) including the die 39 having the side wall forming portion 39*a* of which the inclination angle with respect to the horizontal direction was constant as illustrated in FIG. 5, and a tool of press forming 21 (Comparative Example 1) including the die 29 having a conventional shape and having a die shoulder portion 29*b* of which the radius curvature was constant (=5 [mm]) as illustrated in FIG. 6 were used to perform a crash forming process on blanks 3 having mutually-different blank radius values. In the second example, it was checked to see whether wrinkles occurred or not by varying the press-formed-product height h of the press-formed product 11 in each of these situations. The inclination angle of the side wall forming portion 39*a* with respect to the horizontal direction in Example 2 of the present invention was a maximum inclination angle (=87.7 [°]) calculated from the inclination angle of the side wall portion 15 of the press-formed product 11 with respect to the horizontal direction. Results from the second example are presented in Table 2.

TABLE 2

| Side wall forming portion of die | Blank radius [mm] 85 | 90 | 95 | 100 | Notes |
|---|---|---|---|---|---|
| Optimal cross-sectional shape A | OK | OK | OK | OK | Example 1 of the present invention |
| Constant inclination angle | OK | OK | OK | OK | Example 2 of the present invention |
| Constant radius curvature (=5 mm) | OK | OK | Not OK | Not OK | Comparative Example 1 |

OK: No wrinkles
Not OK: Wrinkles occurred

As indicated in Table 2, in Example 1 of the present invention and Example 2 of the present invention, no wrinkles occurred in the side wall portion 15 of the press-formed product 11, regardless of the values of the blank radius. In particular, even when the blank radius was 100 [mm], it was possible to form the side wall portion 15 without any wrinkles. As understood from Table 2, the results from Example 1 of the present invention and Example 2 of the present invention were better than those from Comparative Example 1 formed by using the conventional tool of press forming 21.

Further, the forming stroke in Example 1 of the present invention, was 80 [mm], whereas the forming stroke in Example 2 of the present invention was 470 [mm]. It was therefore possible to prevent the forming stroke from increasing, by arranging the side wall forming portion 9*a* of the die 9 to have the optimal cross-sectional shape A.

As explained above, it was verified that, by determining the side wall forming portion of the die to have such a cross-sectional shape that constantly keeps the tip end portion of the blank in contact wherewith, it was possible to prevent the occurrence of wrinkles in the side wall portion 15 of the press-formed product 11, even when the press-formed-product height h was high. Further, it was indicated that, by arranging the side wall forming portion of the die to have the optimal cross-sectional shape, it was possible to form the side wall portion 15 of the press-formed product 11 without significantly increasing the forming stroke.

Third Example

In a third example, it was checked to see whether wrinkles occurred or not in the side wall portion 55 of the press-formed product 51, when the disc-shaped press-formed product 51 illustrated in FIG. 15 was formed by performing a crash forming process while using the tool of press forming 1 according to the present invention.

As illustrated in FIG. 15, the press-formed product 51 has the top portion 53 and the side wall portion 55. The top portion 53 and the side wall portion 55 are connected together in continuity by the connecting portion 54 represented by an arc-shaped curved plane having a constant curvature. The height of the side wall portion 55 corresponds to the height of the press-formed product 51 (i.e., the press-formed-product height h). In the third example, the press-formed product 51 was formed by using a steel sheet serving as the blank 3 that had a thickness of 1.2 mm and a tensile strength of 590 [MPa] grade, while using the tool of press forming 1 of which the cross-section is illustrated in FIG. 1. As for the dimension of the press-formed product 51, the radius r of the top portion 53 was 90 [mm], whereas the radius curvature of the connecting portion 54 connecting together the top portion 53 and the side wall portion 55 was 8 [mm].

In the third example, an optimal cross-sectional shape of the side wall forming portion 9*a* of the die 9 was determined on the basis of the dimensions of the press-formed product 51 described above, while the parameters in Expression (2) were determined to satisfy pr=80 [mm], R=5 [mm], and t=1.2 [mm]. In that situation, two types of optimal cross-sectional shapes of the side wall forming portion 9*a* were used, namely, an optimal cross-sectional shape B (Example 3 of the present invention) corresponding to br=110 [mm] and an optimal cross-sectional shape C (Example 4 of the present invention) corresponding to br=105 [mm]. In the third example, an analysis was performed on these two types of side wall forming portions 9*a*. Further, the third example corresponds to situations where advantageous effects of the present invention were verified by making comparisons with crash forming processes performed by using the conventional tool of press forming 21 as illustrated in FIG. 6. Two types of the conventional tool of press forming 21 were used, namely, one in which the die shoulder portion 29*b* had a radius curvature of 8 [mm] (Comparative Example 2) and the other in which the die shoulder portion 29*b* had a radius curvature of 2 [mm] (Comparative Example 3).

The third example corresponds to situations where a crash forming process was performed on each of the blanks 3 having mutually-different radius values, while using either the tool of press forming 1 (either Example 3 or Example 4 of the present invention) of which the side wall forming portion 9*a* had the optimal cross-sectional shape or the conventional tool of press forming 21 (either Comparative Example 2 or Comparative Example 3). In the third example, it was checked to see whether wrinkles occurred or not in the side wall portion 55 of each of the obtained press-formed products 51. Results from the third example are presented in Table 3.

TABLE 3

| Side wall forming portion of die | Blank radius [mm] 100 | 102 | 105 | 110 | Notes |
|---|---|---|---|---|---|
| Optimal cross-sectional shape B (br = 110 mm) | OK | OK | OK | OK | Example 3 of the present invention |
| Optimal cross-sectional shape C (br = 105 mm) | OK | OK | OK | Not OK | Example 4 of the present invention |
| Constant radius curvature (=8 mm) | OK | Not OK | Not OK | Not OK | Comparative Example 2 |
| Constant radius curvature (=2 mm) | Not OK | Not OK | Not OK | Not OK | Comparative Example 3 |

OK: No wrinkles
Not OK: Wrinkles occurred

As indicated in Table 3, compared to Comparative Example 3 in which the radius curvature of the die shoulder portion 29*b* was 2 [mm], Comparative Example 2 having a greater radius curvature exhibited a slightly better wrinkle prevention effect. However, by using the tool of press forming 1 including the side wall forming portion 9*a* that had either the optimal cross-sectional shape B or the optimal cross-sectional shape C presented as Examples 3 and 4 of the present invention, it was possible to press-form the side wall portion 55 of the press-formed product 51 without any wrinkles, with even greater blank radius values.

As explained above, it was verified that, by using the tool of press forming according to the present invention, it is possible to significantly improve the wrinkle prevention effect, compared to situations using the conventional tool of press forming.

INDUSTRIAL APPLICABILITY

As explained above, the press forming method and the tool of press forming according to the present invention are useful in the crash forming processes of the press-formed products. In particular, the press forming method and the tool of press forming are suitable as a press forming method and a tool of press forming used for easily forming, in a single step, the side wall portion curving toward the outside of the press-formed product to have a convex shape in a planar view, while preventing the occurrence of wrinkles.

REFERENCE SIGNS LIST

1 TOOL OF PRESS FORMING
3 BLANK
5 PUNCH
5*a* FORMING TOP PORTION
5*b* PUNCH SHOULDER PORTION
5*c* FORMING WALL PORTION
7 PAD
9 DIE
9*a* SIDE WALL FORMING PORTION
11 PRESS-FORMED PRODUCT
13 TOP PORTION
14 CONNECTING PORTION
15 SIDE WALL PORTION
19 WRINKLES
21 (CONVENTIONAL) TOOL OF PRESS FORMING
29 (CONVENTIONAL) DIE
29*b* (CONVENTIONAL) DIE SHOULDER PORTION
31 TOOL OF PRESS FORMING
39 DIE
39*a* SIDE WALL FORMING PORTION
41 BASIC BLANK
43 SMALLER BLANK
51 PRESS-FORMED PRODUCT
53 TOP PORTION
54 CONNECTING PORTION
55 SIDE WALL PORTION

The invention claimed is:

1. A tool of press forming for forming a press-formed product having no flange portion, the press-formed product including at least a top portion and a side wall portion continued from the top portion via a connecting portion, and the press-formed product being structured so that either all or a part of the side wall portion curves toward an outside of the press-formed product to form a convex shape in a planar view, the tool of press forming comprising:

a punch that has: (i) a forming top portion that is configured to support a blank, (ii) a punch shoulder portion that is continued from the forming top portion and that is configured to extend along a curvature of the press-formed product, and (iii) a forming wall portion continued from the punch shoulder portion; and a die that has a side wall forming portion that is configured to form the side wall portion of the press-formed product by moving the die relative to the punch, wherein:

in an X-Y coordinate system in which an origin is a point serving as a center of a radius curvature of a curvature on the forming top portion: (i) an X-axis corresponds to a horizontal direction, (ii) a Y-axis corresponds to a vertical direction, (iii) an optimal curve is a curve drawn by a formula presented below, and (iv) an optimal inclination angle is an inclination angle of a tangential line of the optimal curve at an arbitrary X-coordinate position, the side wall forming portion of the die has a cross-sectional shape expressed with a curve where an inclination angle of a tangential line at the arbitrary X-coordinate position with respect to the horizontal direction is equal to or greater than the optimal inclination angle, and the formula of the optimal curve is:

$$\left.\begin{aligned} X &= pr - R + (R + t)\sin\theta + \left\{br - (pr - R) - \left(R + \frac{t}{2}\right)\theta\right\}\cos\theta \\ Y &= -\int_0^{\theta}\left[\frac{t}{2}\sin\theta - \left\{br - (pr - R) - \left(R + \frac{t}{2}\right)\theta\right\}\sin\theta\tan\theta\right]d\theta \end{aligned}\right\}$$

where:

pr: a radius [mm] of the punch;

R: a radius curvature [mm] of the punch shoulder portion;

br: a radius [mm] of the blank;

t: a thickness [mm] of the blank; and

θ: a contact angle ($0 \leq \theta \leq \pi/2$) [rad] of the blank with respect to the punch shoulder portion.

* * * * *